US009743821B2

(12) United States Patent
Baldwin et al.

(10) Patent No.: US 9,743,821 B2
(45) Date of Patent: Aug. 29, 2017

(54) DISPENSER FOR MULTI-COMPARTMENT DISHWASHER

(75) Inventors: Mark W. Baldwin, Saint Joseph, MI (US); Mike S. Hemry, Stevensville, MI (US); Barry E. Tuller, Stevensville, MI (US); Ameresh B. Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1351 days.

(21) Appl. No.: 13/447,324

(22) Filed: Apr. 16, 2012

(65) Prior Publication Data

US 2013/0269736 A1 Oct. 17, 2013

(51) Int. Cl.

| | |
|---|---|
| ***A47L 15/02*** | (2006.01) |
| ***A47L 15/14*** | (2006.01) |
| ***A47L 15/44*** | (2006.01) |
| ***A47L 15/00*** | (2006.01) |
| ***A47L 15/42*** | (2006.01) |

(52) U.S. Cl.

CPC ..... *A47L 15/0078* (2013.01); *A47L 15/0084* (2013.01); *A47L 15/14* (2013.01); *A47L 15/4221* (2013.01)

(58) Field of Classification Search

CPC .. A47L 15/0078; A47L 15/4221; A47L 15/14; A47L 15/0084

See application file for complete search history.

(56) References Cited

U.S. PATENT DOCUMENTS

| | | | | |
|---|---|---|---|---|
| 3,430,638 | A | 3/1969 | Brollo | |
| 4,561,904 | A | 12/1985 | Eberhardt, Jr. | |
| 5,331,986 | A | 7/1994 | Lim et al. | |
| 6,189,551 | B1 * | 2/2001 | Sargeant | A47L 15/0021 134/200 |
| 7,069,181 | B2 | 6/2006 | Jerg et al. | |
| 8,043,437 | B1 | 10/2011 | Delgado et al. | |
| 2004/0007256 | A1 * | 1/2004 | Durazzani | A47L 15/4251 134/57 D |
| 2005/0060229 | A1 * | 3/2005 | Riedl | G06Q 30/02 705/14.61 |
| 2006/0284525 | A1 * | 12/2006 | Gorini | A47L 15/4229 312/228 |

(Continued)

FOREIGN PATENT DOCUMENTS

| | | | |
|---|---|---|---|
| CH | 218328 | A | 12/1941 |
| DE | 1980332 | U | 3/1968 |

(Continued)

OTHER PUBLICATIONS

Machine Translation of DE 60200222 to Gobbi et al., Dec. 2004.*

(Continued)

*Primary Examiner* — Michael Barr
*Assistant Examiner* — Benjamin L Osterhout
(74) *Attorney, Agent, or Firm* — McGarry Bair PC

(57) ABSTRACT

A multi-compartment dishwasher may include a treating chemistry dispenser for storing and dispensing treating chemistry into the multiple compartments of the dishwasher. In one embodiment, the treating chemistry may be dispensed into a liquid recirculation circuit. In another embodiment, the treating chemistry dispenser may be located between the multiple chambers of the dishwasher.

14 Claims, 9 Drawing Sheets

(56) References Cited

U.S. PATENT DOCUMENTS

| | | | | |
|---|---|---|---|---|
| 2007/0039634 | A1* | 2/2007 | Hruby | A47L 15/4409 134/25.2 |
| 2007/0119478 | A1* | 5/2007 | King | A47L 15/46 134/18 |
| 2007/0246070 | A1* | 10/2007 | Gunnerson | A47L 15/44 134/18 |

FOREIGN PATENT DOCUMENTS

| | | | |
|---|---|---|---|
| DE | 60200222 | T2 | 12/2004 |
| EP | 0755650 | A1 | 1/1997 |
| EP | 1319360 | A1 | 6/2003 |
| EP | 1776914 | A1 | 4/2007 |
| JP | 2005110901 | A | 4/2005 |
| JP | 2007044550 | A | 2/2007 |
| WO | 2009123530 | A1 | 8/2009 |

OTHER PUBLICATIONS

German Search Report for Counterpart DE102013101661, Dec. 20, 2013.

European Search Report for Counterpart EP12194115.7, Mar. 28, 2013.

* cited by examiner

DISPENSER FOR MULTI-COMPARTMENT DISHWASHER

BACKGROUND

Contemporary automatic household dishwashers may have multiple, separate compartments for receiving soiled utensils to be treated. Typically, in such dishwashers, each compartment may receive treatment chemistry, such as detergent or rinse aid, from a dedicated chemistry dispenser to treat the soiled utensils. Consequently, the dishwasher may include multiple chemistry dispensers to accommodate the multiple compartments.

SUMMARY

A dishwasher according to one embodiment may comprise a first tub at least partially defining a first treating chamber, a second tub at least partially defining a second treating chamber, a recirculation system comprising a pump having an inlet and an outlet, a first fluid return line fluidly coupling the first tub to the pump inlet, and a second return line fluidly coupling the second tub to the pump inlet, and a bulk treating chemistry dispenser fluidly coupled to one of the first and second fluid return lines. The bulk treating chemistry may be dispensed into the one of the first and second fluid return lines, and the recirculation system may direct the dispensed chemistry to the desired one of the first and second treating chambers.

DESCRIPTION OF EMBODIMENTS OF THE INVENTION

Figure 1:
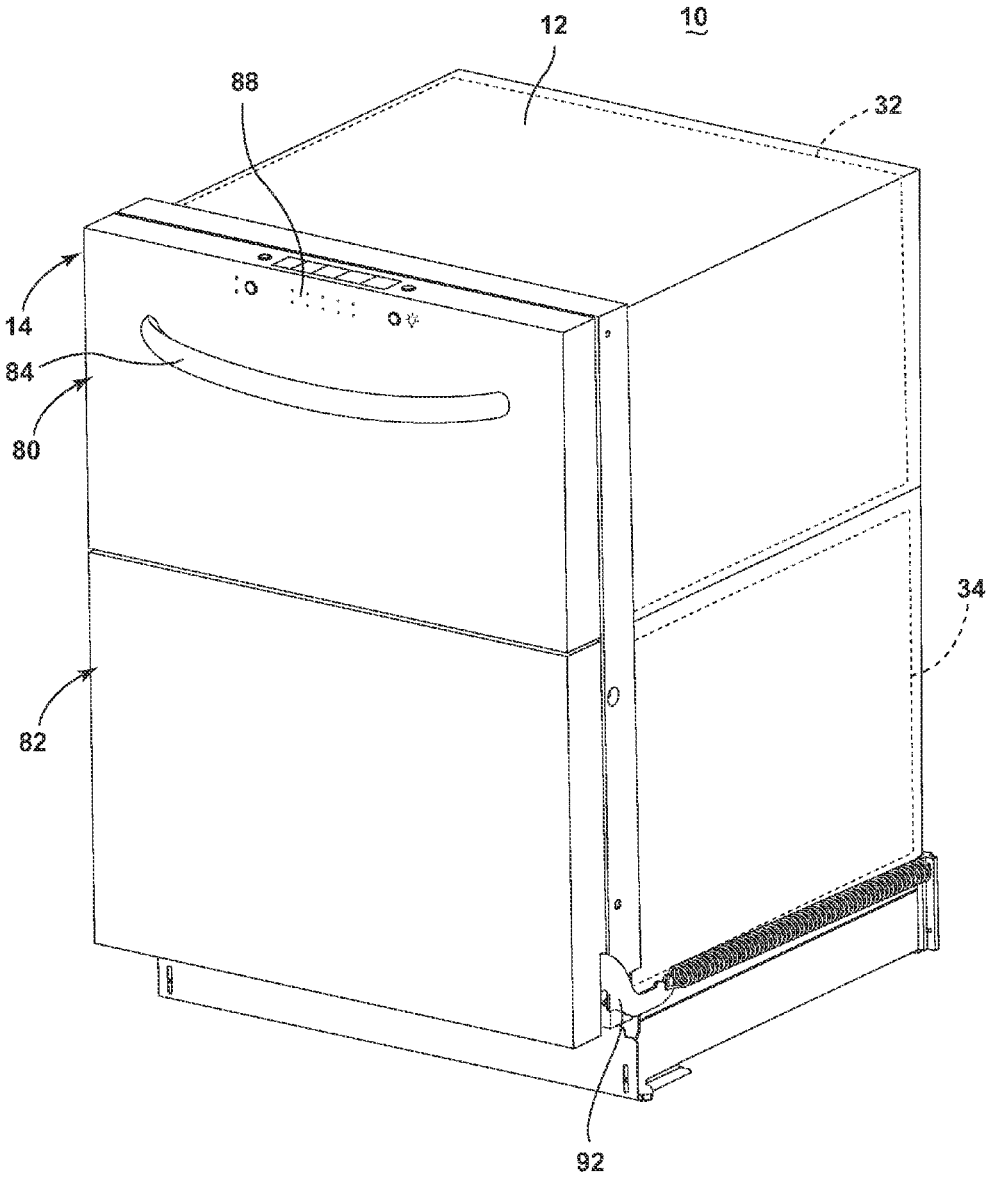
FIG. 1 is a perspective view of a multi-compartment dishwasher according to one embodiment.

FIG. 1 is a perspective view of a multi-compartment dishwasher 10 according to an embodiment of the invention. Although the actual dishwasher 10 into which the embodiments of the invention may be incorporated may vary, the invention is shown in connection with the dishwasher 10 for illustrative purposes. The dishwasher 10 includes a chassis 12 and a door 14 mounted to the chassis 12. The chassis 12 may be a cabinet or a frame, with or without exterior panels. Built-in dishwashers typically have only a frame without panels, whereas stand-alone dishwashers have a frame with decorative panels covering the frame.

Figure 2:
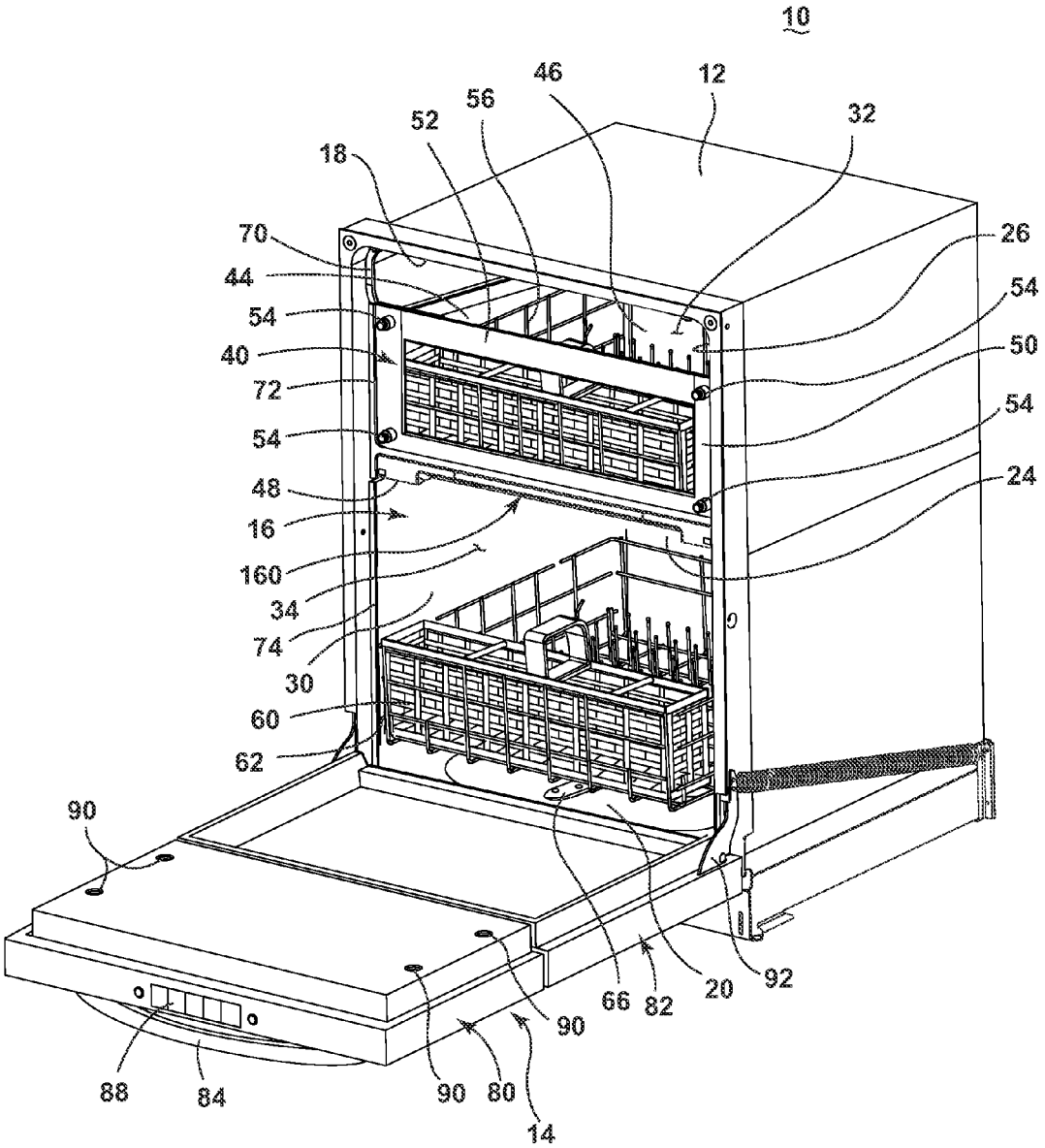
FIG. 2 is a perspective view of the dishwasher of FIG. 1 with a door in a door mode and in an opened position.

Referring now to FIG. 2, which is a front view of the dishwasher 10 with the door 14 in an opened position, the dishwasher 10 may comprise an open-face tub housing or tub 16 having opposing top and bottom walls 18, 20, opposing side walls 22, and a rear wall 24 (FIG. 3) that collectively define an interior with an open face 26. The front edges of the tub top and bottom walls 18, 20 and the opposing side walls 22 define the open face 26, and the door 14 may be moveably mounted to the chassis 12 for selectively closing the open face 26 of the tub 16. The closed position of the door 14 is illustrated in FIG. 1. When the door 14 is in an opened position, as in FIG. 2, the open door 14 provides access to the tub 16 through the open face 26 for loading and unloading utensils or other treatable items. As used in this description, the term "utensil(s)" is intended to be generic to any item, single or plural, that may be treated in the dishwasher 10, including, without limitation, dishes, plates, pots, bowls, pans, glassware, and silverware.

The interior of the tub 16 may include any number of multiple compartments in any arrangement. The illustrated embodiment features two compartments, an upper compartment and a lower compartment, formed by an upper tub 28 and a lower tub 30 that respectively define at least a portion of an upper treating chamber 32 and a lower treating chamber 34. The upper and lower tubs 28, 30 are illustrated as having differing size, with the upper tub 28 being smaller than the lower tub 30; however, the tubs 28, 30 may be of the same size. Further, the upper and lower tubs 28, 30 may have a stacked configuration as illustrated or may alternatively have a side-by-side configuration. The tubs 28, 30 may also be remote from each other in a distributed configuration.

Figure 3:
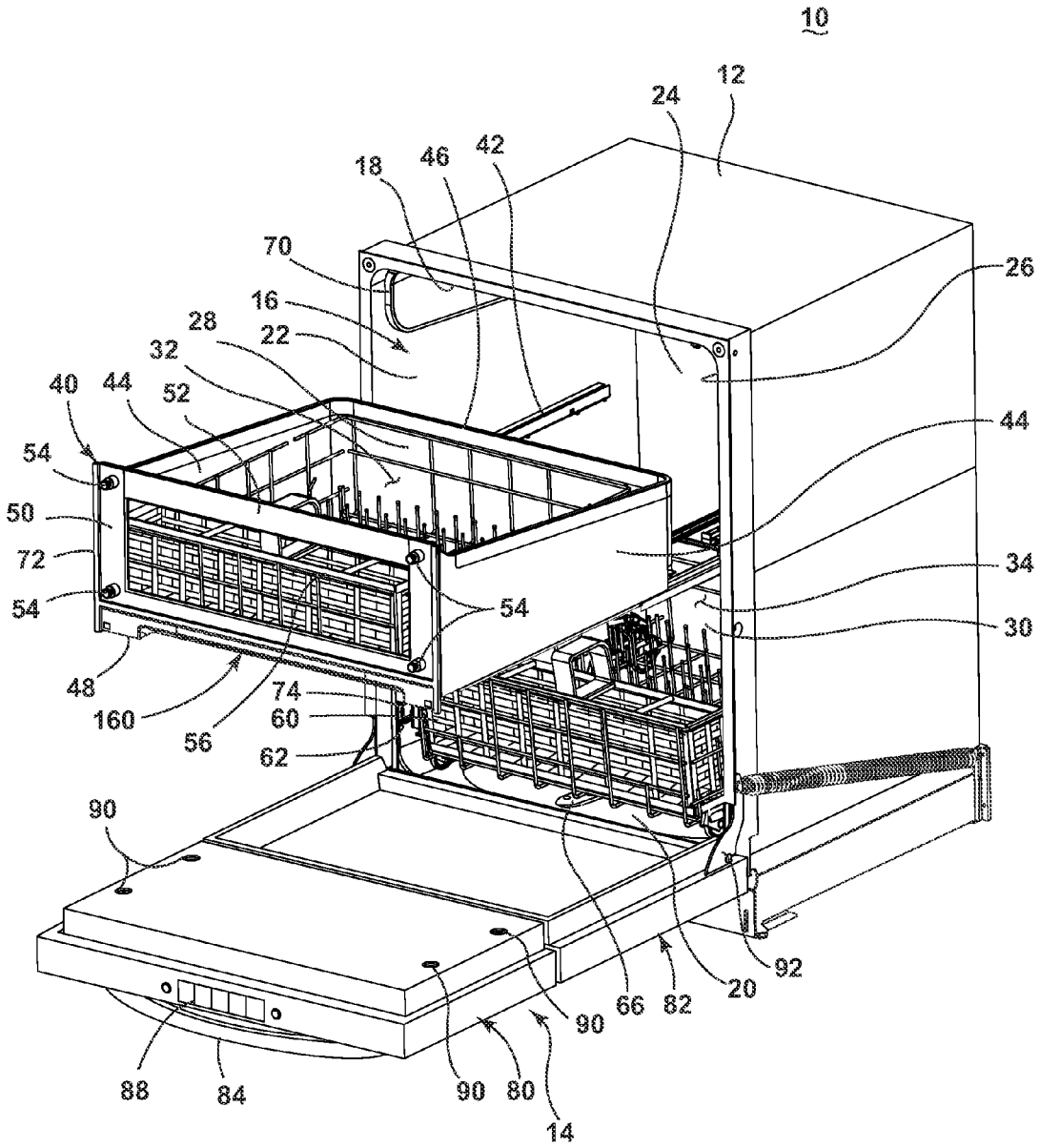
FIG. 3 is a perspective view of the dishwasher similar to FIG. 2 with a drawer carrying an upper utensil rack in an extended position.

As shown in the perspective view of the dishwasher in FIG. 3, the upper tub 28 may be at least partially formed by a drawer 40 slidably mounted to the side walls 22 by slide rails 42. The slide rails 42 may be well-known, conventional drawer slides; alternatively, the drawer 40 may be mounted to the side walls 22 by other suitable extendible support guides or attachment devices. The drawer 40 includes opposing side walls 44 joined by a rear wall 46, a bottom wall 48, and a front frame 50 that supports a drawer handle 52 spanning an upper portion of the frame 50 and forwardly projecting mounting pins 54. The drawer handle 52 facilitates movement of the drawer 40 between an extended position, as shown in FIG. 3, and a retracted position, illustrated previously in FIG. 2. Collectively, the drawer 40 and the portion of the tub 16 above the drawer 40 form the upper tub 28 defining the upper treating chamber 32. The drawer 40 may be provided with a utensil rack 56 for supporting various objects, such as utensils and the like, to be exposed to a treating operation in the upper treating chamber 32. Further, the bottom wall 48 of the drawer 40 may be sloped to function as a sump or fluid outlet to drain treatment fluid from the upper treating chamber 32.

With continued reference to FIG. 2, the lower tub 30 may be collectively formed by the underside of the drawer 40 and the portion of the tub 16 below the drawer 40 to define the lower treating chamber 34. Alternatively, the dishwasher 10 may include a partition, such as a wall, below the drawer 40 to physically separate the tub 16 into the upper and lower tubs 28, 30 rather than having the drawer 40 form the partition. A utensil rack 60 for supporting various objects, such as utensils and the like, to be exposed to a treating operation in the lower treating chamber 34 may be slidably mounted to the side walls 22 by slide rails 62. The slide rails 62 may be well-known, conventional drawer slides; alternatively, the rack 60 may be mounted to the side walls 22 by other suitable extendible support guides or attachment devices. The slide rails 62 enable movement of the rack 60 between a retracted position, as shown in FIG. 2, and an extended position, as is well-known in the dishwasher art. Alternatively, the rack 60 may have wheels on its lower side such that the rack 60 may roll on the door 14 between the retracted and extended positions when the door 14 is in the opened position. Further, the bottom wall 20 of the tub 16 may be sloped to function as a sump or fluid outlet to drain treatment fluid from the lower treating chamber 34.

Figure 5:
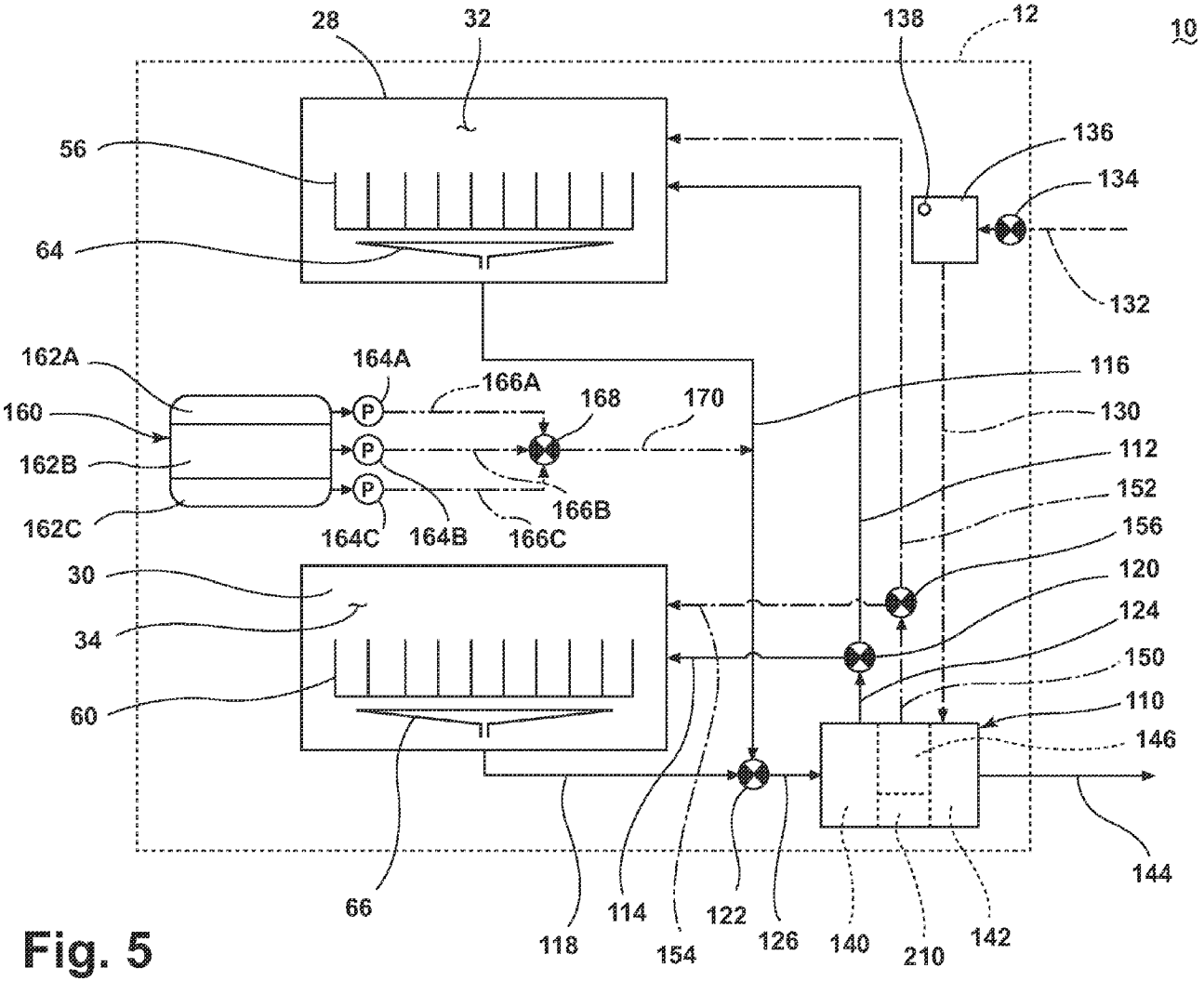
FIG. 5 is a schematic view of a liquid supply system, a liquid recirculation system, an air supply system, and a treating chemistry dispensing system for the dishwasher of FIG. 1.

A spray system may be provided for spraying liquid within the upper and lower treating chambers 32, 34. The spray system may include a sprayer of some type for spraying liquid in the treating chambers 32, 34, and the sprayers in the upper treatment and lower treating chambers 32, 34 function as fluid inlets for the respective upper and lower treating chambers 32, 34. In the current embodiment, the sprayers are in the form of upper and lower spray assemblies 64, 66 and may comprise a traditional spray arm located below the respective utensil racks 56, 60, as shown for illustrative purposes in the figures (FIG. 5). The spray assemblies 64, 66 are configured to rotate in the upper and lower treating chambers 32, 34 and generate a spray of liquid in a generally upward direction, over at least a portion of the respective treating chamber 32, 34, typically directed to treat utensils located in the utensil racks 56, 60. Alternatively or additionally, the spray assemblies 64, 66 may include other types of spray assemblies, including stationary sprayers, zone sprayers, individual spray nozzles, and the like, located at any suitable location, such as on the walls of the respective upper and lower tubs 28, 30 and on the respective utensil racks 56, 60 to provide treating fluid to the upper and lower treating chambers 32, 34. The type, number, and location of the spray assemblies 64, 66 are not germane to the present invention.

Still referring to FIG. 2, a sealing system, which is illustrated in the form of one or more seals, may be located in the dishwasher 10 to prevent fluid leakage between the upper and lower treating chambers 32, 34 and between the door 14 and the tub 16 outside the dishwasher 10. For example, an upper seal 70 may be present around the front perimeter of the tub 16 above the drawer 40 and along the upper edge of the drawer side walls 44 and the drawer rear wall 46, and a drawer front seal 72 may be placed on the side edges and across the lower edge of the drawer front frame 50. Further, a lower seal 74 may be positioned around the front perimeter of the tub 16 below the drawer 40. The portion of the upper seal 70 around the front perimeter of the tub 16, the drawer front seal 72, and the lower seal 74 abut and seal with the door 14 when the door 14 is closed to prevent fluid leakage outside the dishwasher 10. The remaining portions of the upper seal 70 fluidly seal the upper treating chamber 32 from the lower treating chamber 34. While the sealing system of the present embodiment is formed of multiple seals, it is to be understood that the sealing system may have any suitable number of seals, including a single seal, or differing types of seals to accomplish the sealing function, depending on the structure of the dishwasher 10 into which the sealing system is incorporated. For example, the lower seal 74 may include a portion that extends horizontally across the opening of the tub 16 to form a seal for the upper limit of the lower tub 30. In such an embodiment, the horizontal portion of the lower seal 74 could be located along the aforementioned alternative partition separating the upper and lower tubs 28, 30.

The door 14 of the dishwasher 10 may be capable of transforming between a drawer mode and a door mode for accessing selective treating chambers 32, 34 inside the dishwasher 10. While the door 14 will be described briefly below, details of an exemplary transforming door 10 may be found in U.S. Patent Application No. 61/563,058, filed Nov. 23, 2011, which is incorporated herein by reference in its entirety. Further, the door 14 may be any type of dishwasher door, including other types of transforming doors, a conventional non-transforming pivoting door, and conventional sliding drawer fronts.

Referring back to FIG. 1, the illustrated door 14 may have an upper door 80 and a lower door 82 to facilitate transformation between the modes. When the dishwasher 10 is in the drawer mode, the user may move or open only the upper door 80 with a sliding movement for access only to the upper treating chamber 32. Conversely, in the door mode, the user may move or open both the upper and lower doors 80, 82 as a single, full door with a pivoting movement to access both the upper and lower treating chambers 32, 34. The upper and lower treating chambers 32, 34 are shown schematically in phantom in FIG. 1, the boundaries of which are not intended to limit the invention.

The upper door 80 may be generally rectangular and include a handle 84 graspable by a user for moving the door 14 relative to the chassis 12. The handle 84 shown in the figures is for illustrative purposes only; the dishwasher 10 may include any type of handle or other device for moving the door 14 relative to the chassis 12 and may be mounted to any suitable part of the dishwasher 10. The upper door 80 may also carry a user interface 88 to facilitate communication with the user regarding operation of the dishwasher 10. The user interface 88 may be configured, for example, to enable the user to select the drawer or door mode and an operation treating cycle for the upper and/or lower treating chambers 32, 34, along with other features common to dishwasher user interfaces. As seen in FIG. 2, the upper door 80 may further include apertures 90 on its rear face sized and positioned for receipt of the mounting pins 54 on the front frame 50 of the drawer 40. To facilitate transformation between the drawer mode and the door mode for the door 14, a pair of transformation assemblies (not shown) may be positioned within the upper door 80 for interaction with the mounting pins 54 and the lower door 82. Exemplary transformation assemblies are described in the aforementioned and incorporated '058 patent application.

Figure 4:
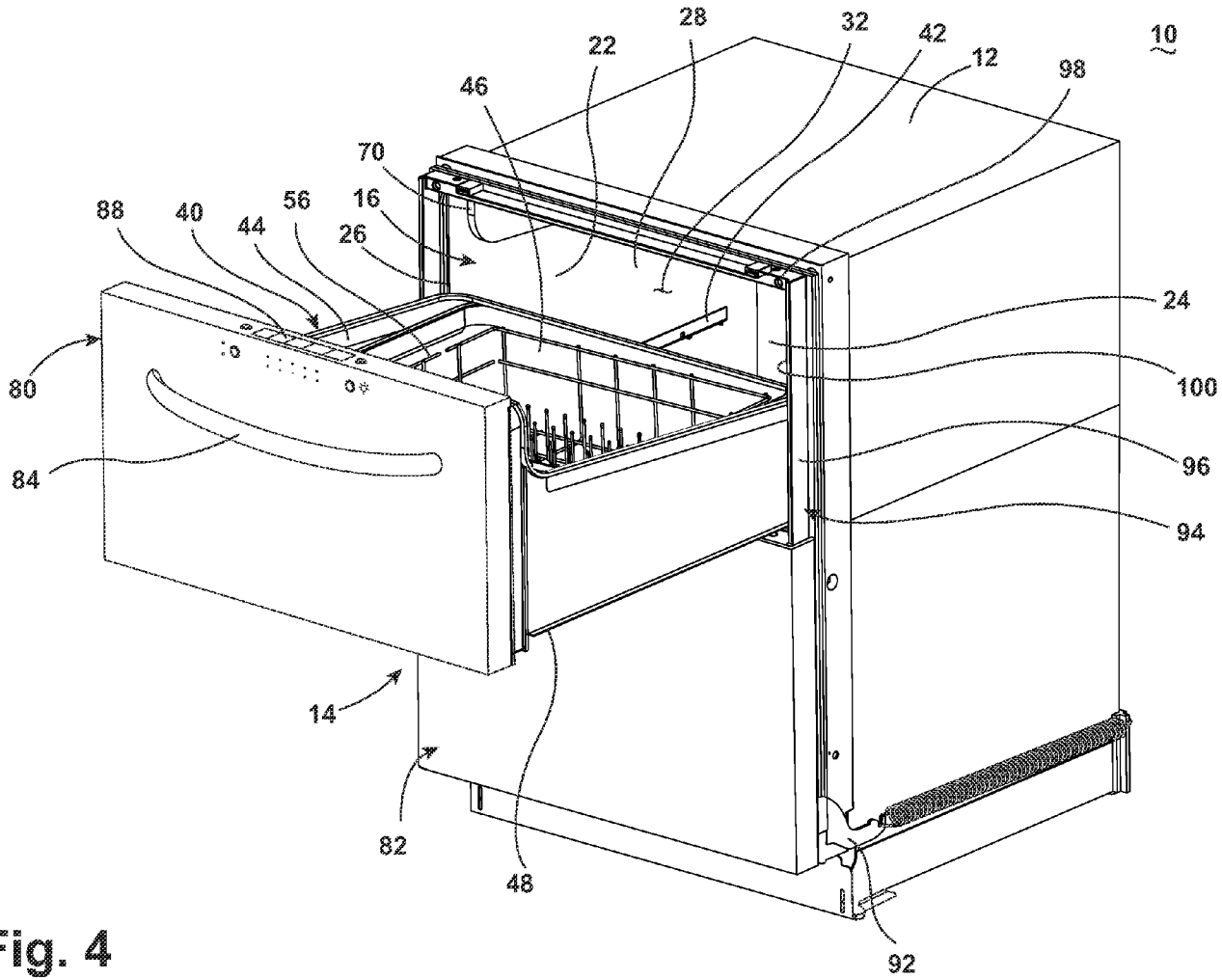
FIG. 4 is a perspective view of the dishwasher of FIG. 1 with the door in a drawer mode and the drawer in the extended position.

With continued reference to FIG. 2, the lower door 82 may be generally rectangular and include a pair of hinges 92 at its lower end to pivotally mount the lower door 82 to the chassis 12. Referring now to FIG. 4, a generally U-shaped door frame 94 having side arms 96 connected at their upper ends by an upper arm 98 may extend upwardly from the generally rectangular portion of the lower door 82 and may be sized for receipt within the periphery of the upper door 80. The frame 94 and the upper edge of the rectangular portion of the lower door 82 may form an access opening 100 through which the drawer 40 may slide when the door 14 is in the drawer mode, as will be described in more detail below. Within the lower door 82, a pair of actuator assemblies (not shown) may be positioned for interaction with the transformation assemblies of the upper door 80 for conversion of the door 14 between the door and drawer modes. Exemplary actuator assemblies are described in the aforementioned and incorporated '058 patent application.

Conversion of the door 14 between the door mode (FIGS. 2 and 3) and the drawer mode (FIG. 4) may be accomplished by coupling and decoupling, respectively, the upper and lower doors 80, 82 while simultaneously decoupling and coupling, respectively, the upper door 80 and the drawer 40. In particular, actuation of the actuator assemblies for the door mode physically moves a portion of the actuator assembly into the upper door 80, which couples the lower door 82 to the upper door 80 at the lower end of the upper door 80, and also moves the transformation assemblies in the upper door 80 to extend upward and physically engage the upper arm 98 of the lower door 82 to couple the lower door 82 to the upper door 80 at the upper end of the upper door 80. The movement of the transformation assemblies also unlocks the mounting pins 54, received by the apertures 90 for interaction with the transformation assemblies, from the upper door 80 such that the upper and lower doors 80, 82 in a coupled condition can pivot relative to the chassis 12 without concurrent movement of the drawer 40.

For conversion to the drawer mode, actuation of the actuator assemblies physically retracts the actuator assemblies into the lower door 82, which decouples the lower door 82 from the upper door 80 at the lower end of the upper door 80, and also retracts the transformation assemblies into the upper door 80 to decouple the lower door 82 from the upper door 80 at the upper end of the upper door 80. The movement of the transformation assemblies also locks the mounting pins 54, received by the apertures 90 for interaction with the transformation assemblies, to the upper door 80 such that the upper door 80, uncoupled from the lower door 82, can slide relative to the chassis 12 and the lower door 82 with concurrent movement of the drawer 40, as shown in FIG. 4.

As shown in the schematic diagram of FIG. 5, the dishwasher 10 may further include a liquid recirculation system, which may include a pump and filter unit 110, for selectively supplying, recirculating, and draining liquid from the upper and lower treating chambers 32, 34. The liquid recirculation system may be fluidly coupled to the spray system having the upper spray assembly 64 and the lower spray assembly 66 described above.

The liquid recirculation system includes several fluid conduits or lines, which are indicated by solid lines in FIG. 5. An upper supply conduit 112 may couple an outlet of the pump and filter unit 110 to an inlet of the upper treating chamber 32, such as via the upper spray assembly 64, for supplying liquid to the upper treating chamber 32 through the upper spray assembly 64. For the lower treatment chamber 34, a lower supply conduit 114 may couple the outlet of the pump and filter unit 110 to an inlet of the lower treating chamber 34, such as via the lower spray assembly 66, for supplying liquid to the lower treating chamber 34 through the lower spray assembly 66. Similar conduits may be present for draining fluid from the upper and lower treating chambers 32, 34 to the pump and filter unit 110. An upper return conduit 116 may fluidly couple an outlet of the upper treating chamber 32, such as via the upper sump formed by the drawer bottom wall 48, with an inlet of the pump and filter unit 110. For the lower treating chamber 34, a lower return conduit 118 may fluidly couple an outlet of the lower treating chamber 34, such as via the lower sump formed by the tub bottom wall 20, with the inlet of the pump and filter unit 110. Portions of the upper and lower supply conduits 112, 114 and of the upper and lower return conduits 116, 118 may be located within the respective upper and lower tubs 28, 30, while other portions may be hidden from the user's view behind the tub 16. To accommodate sliding movement of the drawer 40 and the upper spray assembly 64 and the upper sump that move with the drawer 40, the upper supply conduit 112 and the upper return conduit 116 may include extendible sections and/or may selectively uncouple and recouple with itself or corresponding components of the dishwasher 10. Alternatively, the upper supply and return conduits 112, 116 may be configured such that they are unitary and remain coupled to the corresponding components of the dishwasher 10 during sliding movement of the drawer 40.

The liquid recirculation system may further comprise a liquid diverter system having supply and return diverters 120, 122 to selectively control the liquid movement within and between the lower and upper treating chambers 32, 34. The supply diverter 120 has an inlet fluidly coupled to the outlet of the pump and filter unit 110 and a pair of outlets fluidly coupled to the upper and lower supply conduits 112, 114. In this case, a pump outlet conduit 124 coupling the outlet of the pump and filter unit 110 to the supply diverter 120 functions as either the upper and lower supply conduits 112, 114 depending on the source of the fluid flow. Correspondingly, the pump and filter unit 110 may supply liquid to the upper and lower treating chambers 32, 34 through the pump outlet conduit 124, the supply diverter 120, the respective upper and lower supply conduits 112, 114, and the respective upper and lower spray assemblies 64, 66. The return diverter 122 has a pair of inlets fluidly coupled to the upper and lower return conduits 116, 118 and an outlet fluidly coupled to the inlet of the pump and filter unit 110. In this case, a pump inlet conduit 126 coupling the supply diverter 120 to the inlet of the pump and filter unit 110 functions as either the upper and lower return conduits 116, 118 depending on the source of the fluid flow. Correspondingly, the pump and filter unit 110 may receive liquid drained from the upper and lower treating chambers 32, 34 through the respective upper and lower sumps, the respective upper and lower return conduits 116, 118, the return diverter 122, and the pump inlet conduit 126. The supply and return diverters 120, 122 may be valve type diverters or other types of diverters capable of diverting all or some of the liquid passing therethrough.

In the recirculation system, the fluid conduits or lines form recirculation circuits for the upper and lower treating chambers 32, 34 formed by the upper and lower tubs 28, 30. The upper supply conduit 112 and the upper return conduit 116 define an upper recirculation circuit whereby treating fluid may be supplied from the pump and filter unit 110 to the upper treating chamber 32 and also returned from the upper treating chamber 32 to the pump and filter unit 110. Similarly, the lower supply conduit 114 and the lower return conduit 118 define a lower recirculation circuit whereby treating fluid may be supplied from the pump and filter unit 110 to the lower treating chamber 34 and also returned from the lower treating chamber 34 to the pump and filter unit 110. While the upper and lower treating chambers 32, 34 are physically separate, they may be considered selectively fluidly coupled by the pump and filter unit 110, which functions as a fluid connector for the upper and lower recirculation circuits. In other words, the pump and filter unit 110 may be operated to supply liquid obtained from the upper recirculation circuit to the lower recirculation circuit and vice-versa, if desired.

With continued reference to FIG. 5, the dishwasher 10 may also include a liquid supply system for providing external liquid to the pump and filter unit 110, which selectively supplies the liquid to either or both of the upper and lower treating chambers 32, 34 through the liquid recirculation system. Fluid conduits or lines of the liquid supply system are identified with a dash-dash-dot line in FIG. 5. The liquid supply system may include a liquid supply conduit 130 extending from a liquid source 132, such as a household water supply, to the pump and filter unit 110, and a supply valve 134 may control flow of the liquid from the liquid source 132 to the liquid supply conduit 130 and the pump and filter unit 110. A siphon break or reservoir 136 with an overflow conduit 138 may be located along the liquid supply conduit 130 to aid in supplying the liquid from the liquid source 132 to the pump and filter unit 110. Alternatively, the liquid supply system may employ separate liquid supplies for the upper and lower treating chambers 32, 34.

With continued reference to FIG. 5, the pump and filter unit 110 may be a single assembly incorporating several devices, such as a supply and recirculation pump 140 for pumping liquid from the liquid supply conduit 130 and/or the pump inlet conduit 126 to the pump outlet conduit 124, a drain pump 142 for pumping liquid from the pump inlet conduit 126 to a household drain conduit 144 (indicated by a dotted line in FIG. 5), a liquid filter (not shown) to filter the liquid prior to being supplied to the pump outlet conduit 124, a heater (not shown) for heating the liquid prior to being supplied to the pump outlet conduit 124, and a fan or blower 146. The supply and recirculation pump 140, the drain pump 142, and the blower 146 are shown schematically as components of the pump and filter unit 110 in FIG. 5, the boundaries of which are not intended to show location or relative size of the components but are rather included to indicate only the presence of these components in the pump and filter unit 110. Further details of exemplary pump and filter units may be found in U.S. patent application Ser. No. 12/643,394, filed Dec. 21, 2009, U.S. patent application Ser. No. 12/910,203, filed Oct. 22, 2010, U.S. patent application Ser. No. 12/947,317, filed Nov. 16, 2010, U.S. patent application Ser. No. 12/959,483, filed Dec. 3, 2010, U.S. patent application Ser. No. 12/949,687, filed Dec. 3, 2010, U.S. patent application Ser. No. 12/959,507, filed Dec. 3, 2010, U.S. patent Ser. No. 12/959,673, filed Dec. 3, 2010, U.S. patent application Ser. No. 12/966,420, filed Dec. 13, 2010, and related applications, which are incorporated herein by reference in their entirety. The '673 application further includes additional details of an exemplary liquid recirculation system, including an exemplary liquid diverter system, and an exemplary liquid supply system.

The dishwasher 10 may further include an air supply system that may comprise the blower 146 of the pump and filter unit 110, along with a blower outlet conduit 150 in fluid communication with the upper treating chamber 32 through an upper air supply conduit 152 and with the lower treatment chamber 34 through a lower air supply conduit 154. The air conduits or lines are illustrated as dash-dot-dash lines in FIG. 5. An air diverter 156 may selectively direct air from the blower outlet conduit 150 to one of the upper and lower air supply conduits 152, 154 to thereby selectively deliver air to the upper and lower treating chambers 32, 34, respectively. Optionally, the heater of the pump and filter unit 110 may heat the air prior to delivery to the upper and lower treating chambers 32, 34. Further details of an exemplary air supply system may be found in the aforementioned and incorporated '673 application.

The described and illustrated liquid recirculation system, the liquid supply system, and the air supply system, along with the pump and filter unit 110, are provided for exemplary purposes. Any suitable systems capable of supplying, recirculating, and draining liquid and any suitable system for supplying air may be employed with the dishwasher 10.

The dishwasher 10 may further include a treating chemistry dispensing system configured to store and dispense treating chemistry into the upper and lower treating chambers 32, 34. The treating chemistry dispensing system is illustrated schematically in FIG. 5, where conduits or lines of the dispensing system are shown as dash-dot-dot lines. The dispensing system may include a treating chemistry dispenser 160 having one or more compartments 162, illustrated by example in FIG. 5 as having three of the compartments 162A, 162B, 162C. For exemplary purposes, the three compartments 162A-162C may be a pretreating chemistry compartment, a main wash chemistry compartment, and a rinse aid chemistry compartment. Each of the compartments 162 may be fluidly coupled to the upper return conduit 116 such that the treating chemistries contained within the compartments 162 may be selectively supplied to the liquid recirculation system. Between the dispenser 160 and the upper return conduit 116, the dispensing system may include a set of dispensing pumps 164 having a number of the pumps 164 equal to the quantity of the compartments 162 such that each of the compartments 162 has a corresponding, dedicated pump 164, illustrated as the pumps 164A, 164B, and 164C. Alternatively, the dispensing system may have a single pump configured to pump the chemistries from all of the compartments 162. In the present illustrated embodiment, a compartment supply conduit 166, illustrated as 166A, 166B, and 166C, extends from each of the pumps 164 to a dispensing diverter 168, which has multiple inlets corresponding to the number of and fluidly coupled to the compartment supply conduits 166 and an outlet fluidly coupled to a dispensing conduit 170 fluidly coupled to the upper return conduit 116. The dispensing diverter 168 may be a valve type diverter or other type of diverter capable of diverting all or some of the treating chemistry passing therethrough. Once the treating chemistry is supplied to the liquid recirculation system through the upper return conduit 116, the treating chemistry flows, with or without the aid of a liquid flush provided by the pump and filter unit 110, to the supply and recirculation pump 140 of the pump and filter unit 110, which directs the dispensed treating chemistry, and any fluid containing the dispensed treating chemistry, to one or more of the desired upper and lower treating chambers 32, 34, as will be described in further detail below.

The compartment supply conduits 166A-C and the dispensing conduit 170 may be oriented such that gravity directs the chemistry from the pumps 164A-C to the diverter valve 168 and to the return conduit 116, respectively. While not illustrated, it is also contemplated that a liquid supply conduit may be provided to any of the pumps 164A-C, the compartment supply conduits 166A-C, or the dispensing conduit 170 to flush the treating chemistry supplied by the pumps 164A-C from either or both of the compartment supply conduits 166A-C and the dispensing conduit 170 to the return conduit 116. The liquid supply for flushing may come from the liquid source 132 through the supply valve 134, through the pump and filter unit 110, or from another source.

The plumbing between the dispenser 160 and the upper return conduit 116 may differ from that shown in FIG. 5 and described above. The plumbing system presented herein is provided for exemplary purposes and may be altered, if desired, in any suitable manner for providing the treating chemistry from the dispenser 160 to the liquid recirculation system. As an example, the plumbing may include an additional valve between the dispensing conduit 170 and the upper return line 116, or the dispensing diverter 168 may couple directly to the upper return line 116 without the intervening dispensing conduit 170. Further, the dispenser 160 may be fluidly coupled to other conduits or lines of the liquid recirculation system, such as to the lower return conduit 118 in addition to or as an alternative to the upper return conduit 116.

The treating chemistry may be any suitable chemistry for use in treating utensils in a dishwasher, such as detergents and rinse aids, and may include chemistry for cleaning the dishwasher itself. The treating chemistry may be in the form of a single charge of a treating chemistry or a bulk treating chemistry form having multiple charges of a treating chemistry. Further, the dispenser may be adapted to receive different types of the treating chemistries in individual packages for individual supply and replacement into the dispenser 160, or the different types of the treating chemistries may be in the form of a single, compound package or cartridge containing all of the treating chemistries for replacement of all of the treating chemistries at one time. Alternatively, the treating chemistries may be filled into the dispenser as needed without the use of packages or cartridges. Additionally, the treating chemistry may have any suitable consistency, such as a liquid, gel, loose powder, compacted powder, or other solid form, for example.

Figure 6:
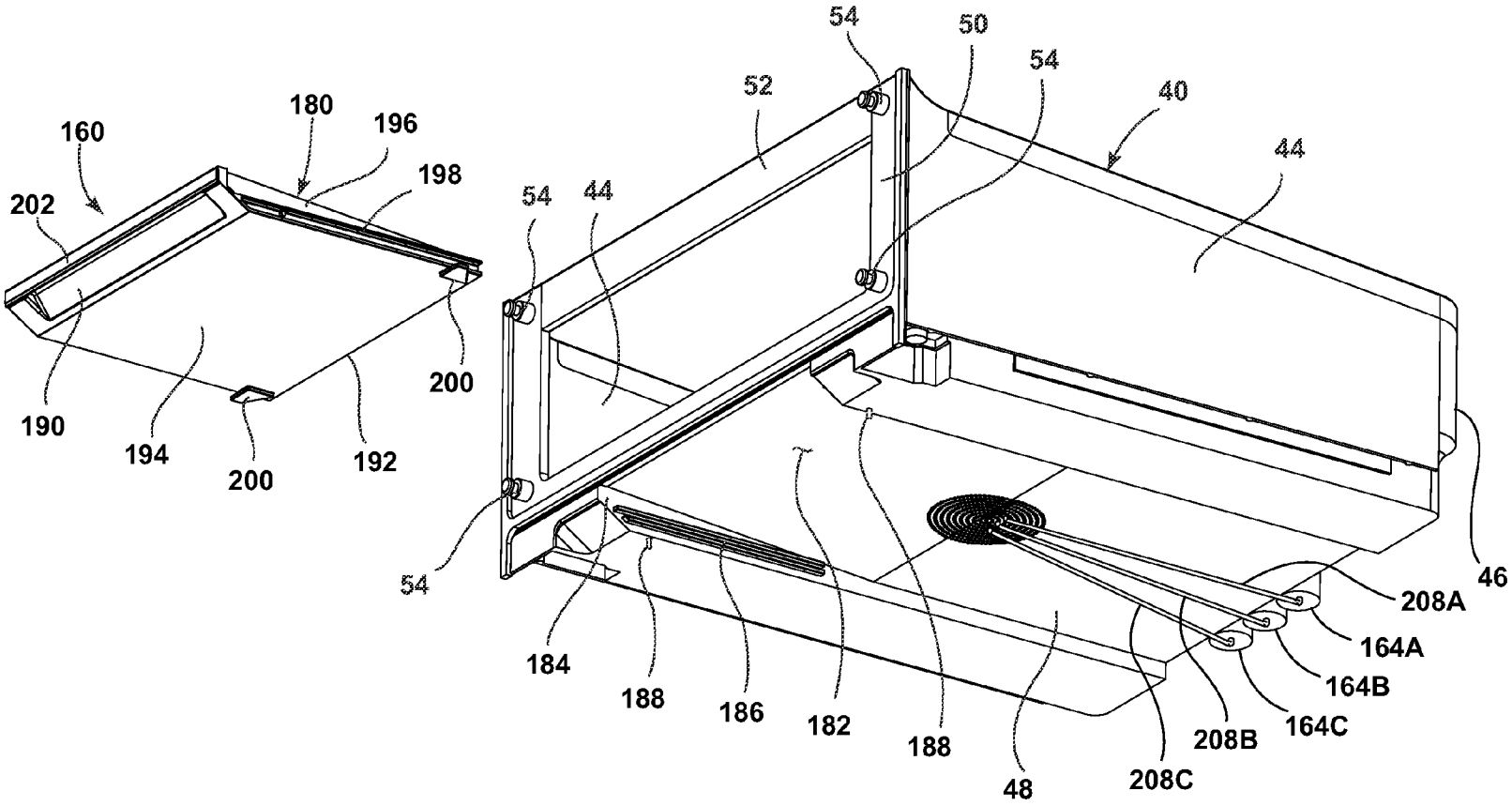
FIG. 6 is an exploded view of a treating chemistry dispenser of the dishwasher of FIG. 1.

Referring back to FIG. 2, the treating chemistry dispensing system of the present embodiment may be mounted to the bottom of the drawer 40, particularly to the bottom wall 48 of the drawer 40 dividing the upper and lower tubs 28, 30 such that the treating chemistry dispenser 160 is located adjacent to the divider. The dispenser 160 may include a dispensing drawer 180 slidably mounted to the drawer 40, best seen in the exploded view of FIG. 6. The front portion of the bottom wall 48 of the drawer 40 may slope downward from the front to the middle of the bottom wall 48 to form the upper sump, as mentioned above, and this slope provides a wedge-shaped drawer space 182 below the bottom wall 48 of the drawer 40 to accommodate the dispensing drawer 180. The drawer space 182 may be formed by the bottom wall 48 and a pair of opposing side walls 184 depending from the bottom wall 48 and carrying a set of parallel, generally horizontal slide guides 186 extending from the front to the rear of the side walls 184. Further, the drawer 40 may support a pair of drawer stops in the form of pins 188 depending from a bottom surface of the drawer 40 generally planar with and adjacent to the bottom of the dispensing drawer 180.

The dispensing drawer 180 may be generally wedge-shaped in accordance with the shape of the space 182 formed by the sloped bottom wall 48 of the drawer 40. The dispensing drawer 180 may be an open-top drawer having a front wall 190, a rear wall 192 having a height less than that of the front wall 190, a generally horizontal bottom wall 194, and a pair of opposing side walls 196 having a downwardly sloping top edge to accommodate the height difference between the front and rear walls 190, 192. The side walls 196 each support a generally horizontal runner 198 sized for receipt by the respective slide guides 186 on the drawer 40, and a pair of projections 200 depend from the rear corners of the bottom wall 194 and extend laterally of the bottom wall 194 for interaction with the stop pins 188 to limit forward movement of the dispensing drawer 180, which may be facilitated by the user grasping a handle 202 extending along the width of the front wall 190. The handle 202 may be generally planar with the front frame 50 of the drawer 40 when the dispensing drawer 180 is fully retracted into the space 182. The dispensing drawer 180 in an extended position may be viewed in FIG. 7; the dispensing drawer 180 may be carried with the drawer 40 and may be moved relative to the drawer 40 when the drawer 40 is in its extended or retracted positions.

Figure 8:
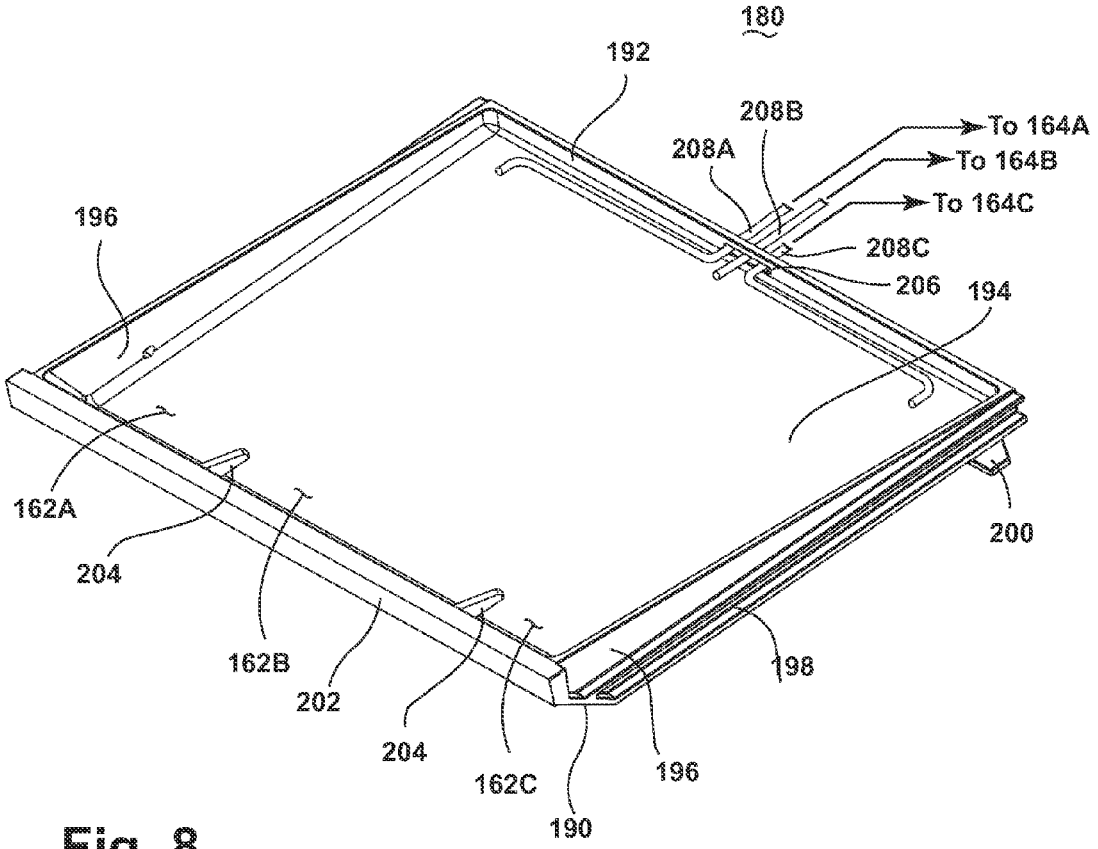
FIG. 8 is a perspective view of the dispensing drawer of the treating chemistry dispenser of FIG. 6.

As shown in the perspective view of the dispensing drawer 180 in FIG. 8, the walls 190, 192, 194, 196 of the dispensing drawer 180 form the interior of the dispensing drawer 180, which may be divided into the multiple compartments 162, if desired. In the illustrated embodiment, a set of partitions 204 along the front wall 190 and a portion of the bottom wall 194 divide the interior into the compartments 162. The compartments 162, as mentioned above, may be dedicated to specific types of treating chemistries, such as pre-wash detergent, main wash detergent, and rinse aid chemistry, or, alternatively, the dishwasher 10 may be configured for detection of the type of treating chemistry such that the user may place any desired treating chemistry into the compartments 162.

In the present embodiment, the dispensing drawer 180 may be configured to receive a cartridge containing the three types of treating chemistries such that the compartments 162 in the dispensing drawer 180 are partially defined by the partitions 204 and also by the inherent separation of the treating chemistries in the cartridge. In alternative embodiments, the dispensing drawer 180 may be configured with the partitions 204 extending the entire depth of the dispensing drawer 180 from the front wall 190 to the rear wall 192 to completely separate the compartments 162. This alternative embodiment may be adapted to receive independent packages of treating chemistries sized for receipt in the compartments 162 or manual fill of the treating chemistries into the compartments 162 (e.g., the user pouring a treating chemistry manually into the compartment). Optionally, while not shown, the dispensing drawer 180 may have a cover to close its open top; the cover may have any form, including a sliding cover and a pivoting cover. The cover may be translucent so as to provide visual access of the interior of the dispensing drawer 180 to the user. The dispensing drawer 180 may also include indicia to communicate to the user the type of treating chemistry the compartments 162 may receive.

As seen in FIG. 8, the rear wall 192 may include a slot 206 or other opening to accommodate conduits, such as the exemplary pump conduits 208A, 208B, 208C, or other plumbing necessary for coupling the compartments 162 and the treating chemistries contained therein to the dispensing pumps 164 for dispensing the treating chemistries from the dispensing drawer 180 to the liquid recirculation system. The conduits 208A-C may be configured with a receiver designed to couple with a corresponding structure on a cartridge or package of treating chemistry such that the cartridge or package fluidly couples with the conduits 208A-C upon being inserted into the dispensing drawer 180. The conduits 208A-C may be extendable to accommodate the sliding movement of the dispensing drawer 180; examples include, but are not limited to, telescoping conduits or corrugated conduits. As another option, the conduits 208A-C may decouple and recouple upon sliding movement of the drawer. Alternatively, the conduits 208 may be fluidly coupled to the respective compartments 162 in any other suitable manner depending on the configuration of the dispensing drawer 180 and the type of treating chemistry, or the pumps 164 may be mounted to or otherwise carried by the dispensing drawer 180, thereby eliminating the need for the conduits 208. The pumps may be located elsewhere, such as mounted to the drawer 40 as in the current embodiment, shown by example in FIG. 6, or positioned behind the tub 16.

The treating chemistry dispensing system and other systems and components of the dishwasher 10 communicate with an electronic control, shown in the illustrated embodiment as a controller 210, that may be located in the chassis 12 below the tub 16 as part of the pump and filter unit 110 (FIG. 5). The controller 210 may be a single controller for both the upper and lower treating chambers 32, 34 and may be operably coupled to various components of the dishwasher 10 to implement a treating cycle of operation in one or both of the upper and lower treating chambers 32, 34 and to transform the door 14 between the drawer and door modes. As illustrated herein, the controller 210 may be part of the pump and filter unit 110 to provide a compact and modular assembly for installation within the dishwasher 10; however, one or more components shown as integrated with each other in the pump and filter unit 110 may also be provided separately. Further, the controller 210 may be positioned in locations of the dishwasher 10 other than below the tub 16, such as in other locations on the chassis 12 or on the door 14.

Figure 9:
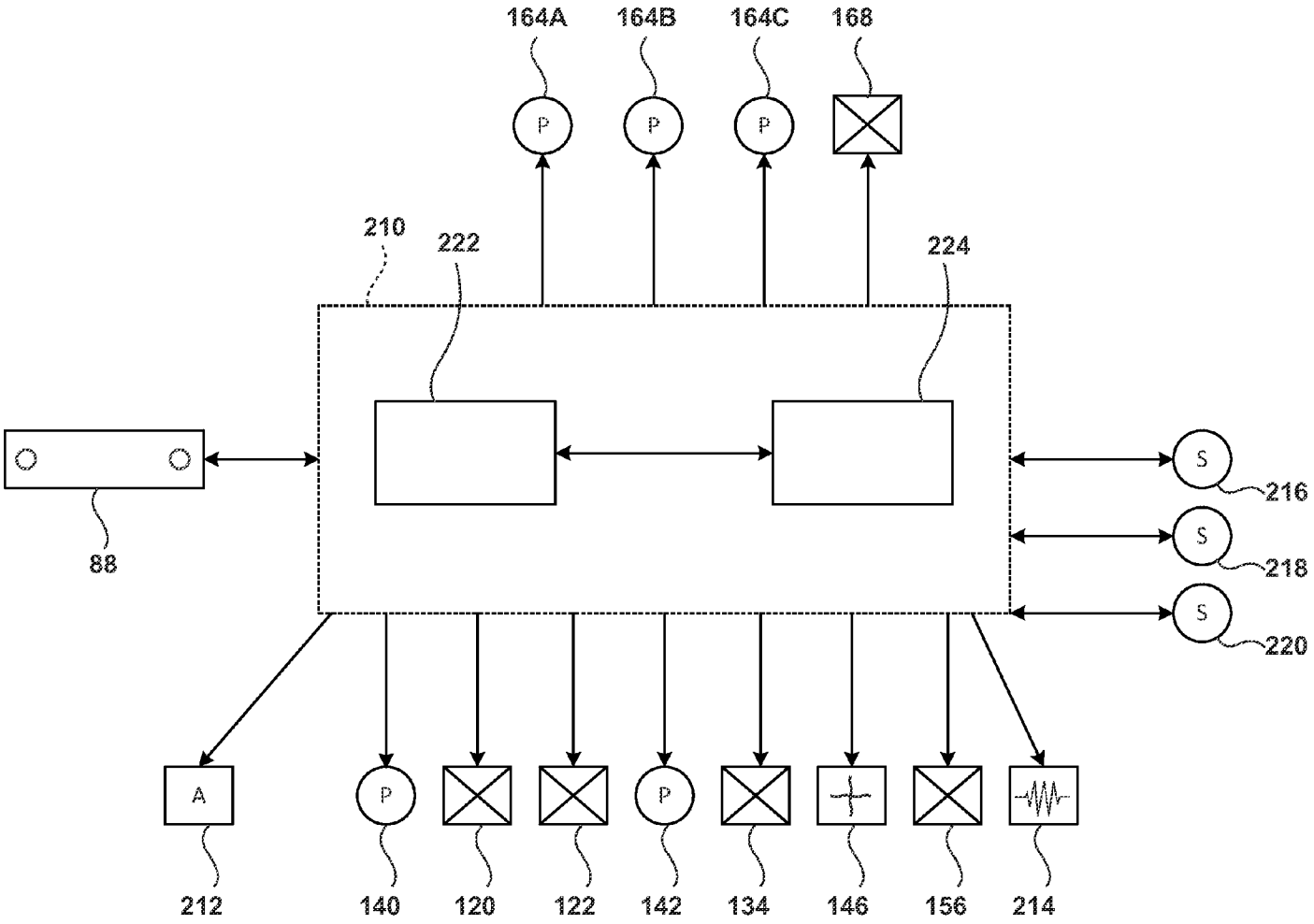
FIG. 9 is a schematic view of an embodiment of a controller and components operably coupled to the controller for the dishwasher of FIG. 1.

Referring now to FIG. 9, which is a schematic view of the controller 210 for the dishwasher 10, the controller 210 may be operably coupled to the user interface 88 to communicate with the user regarding the selection of treatment cycles and options, operation status, and the selection and status of the mode of the door 14. Further, the user interface 88 may be configured to communicate to the user a status of the treating chemistries in the treating chemistry dispenser 160, such a status related to the quantity and/or type of the treating chemistry present in the dispenser 160. The controller 210 may also be coupled with the actuator assemblies 212 to execute transformation of the door 14 between the drawer and door modes according to the mode selected by the user via the user interface 88.

Additionally, the controller 210 may be coupled with the supply and recirculation pump 140, the supply diverter 120, and the return diverter 122 for supply and circulation of fluid in the upper and lower treating chambers 32, 34 and with the drain pump 142 for drainage of fluid from the dishwasher 10. The controller 210 may be coupled with the supply valve 134 for supplying liquid to the pump and filter unit 110. The controller 210 may also be operably coupled with the blower 146 and the air diverter 156 to provide air into the upper and lower treating chambers 32, 34. The controller 210 may also be coupled with the heater 214 to heat the fluid and/or air depending on the step being performed in the cycle of operation. The controller 210 may also be coupled to the treating chemistry dispensing system, particularly the pumps 164 and the dispensing diverter 168, for dispensing a treating chemistry during appropriate steps in a cycle of operation into the upper and/or lower treating chambers 32, 34.

The controller 210 may also be coupled with one or more temperature sensors 216, which are known in the art, such that the controller 210 may control the duration of the steps of the cycle of operation based upon the temperature detected in the upper and lower treating chambers 32, 34 or in one of the various conduits of the dishwasher 10. The controller 210 may also receive inputs from positional sensors 218 that may detect the opened or closed positions of the door 14 and/or alignment of the upper and lower doors 80, 82. Further, the controller 210 may also communicate with one or more other additional sensors 220, examples of which are known in the art. Non-limiting examples of the additional sensors 220 that may be communicably coupled with the controller 210 include a moisture sensor and a turbidity sensor.

The controller 210 may also be provided with a memory 222 and a central processing unit (CPU) 224. The memory 222 may be used for storing control software that may be executed by the CPU 224 in completing a cycle of operation using one or both of the upper and lower treating chambers 32, 34 of the dishwasher 10 and any additional software. For example, the memory 222 may store one or more pre-programmed cycles of operation that may be selected by a user and completed by one or more of the upper and lower treating chambers 32, 34. A cycle of operation for the upper and lower treating chambers 32, 34 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of fluid and/or rinse aid used during each of the multiple rinse steps may be varied. The drying step may have a non-heated drying step (so called "air only"), a heated drying step, or a combination thereof. These multiple steps may be performed by one or both of the upper and lower treating chambers 32, 34 in any desired combination.

The operation of the dishwasher 10 will now be described with a focus on the operation of the treating chemistry dispensing system. Details regarding the transformation of the door 14 and the delivery of heated and non-heated air to the upper and lower treating chambers 32, 34 may be found in the aforementioned and incorporated '058 and '673 applications. The following description is provided for descriptive purposes only with the understanding that the operation may proceed in any suitable order and may be adapted according to variations of embodiments of the dishwasher 10. While the operation description will include reference to different figures, inherent reference to FIG. 9 may continually be made when discussing communication between the controller 210 and various systems and components of the dishwasher 10.

Figure 7:
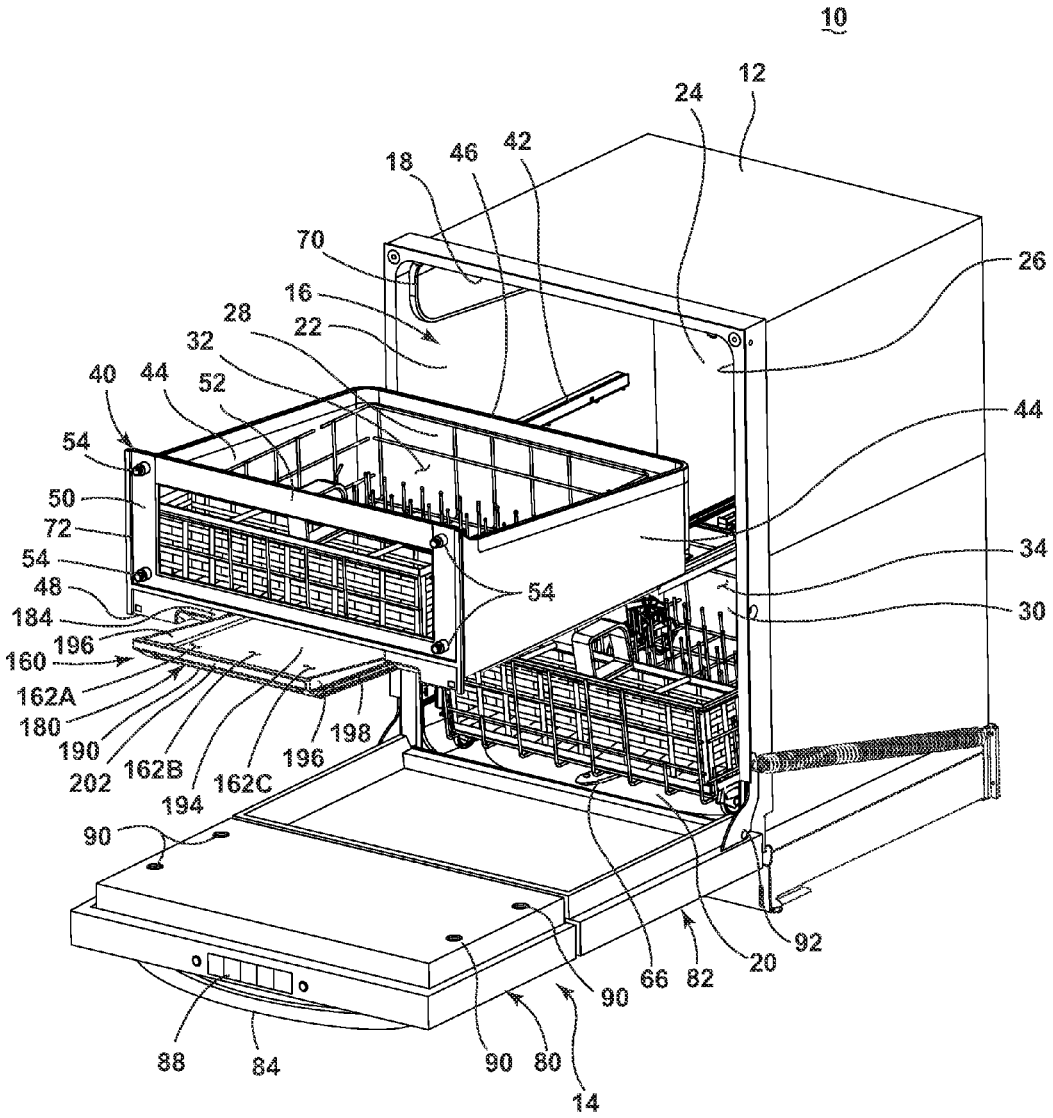
FIG. 7 is a perspective view of the dishwasher similar to FIG. 3 with a dispensing drawer in an extended position.

To use the dishwasher 10, a user places utensils to be treated in the desired upper and lower utensil racks 56, 60 and fills the treating chemistry dispenser 160 with the treating chemistry if not already present in the dishwasher 10. To access the dispenser 160 in the illustrated embodiment of the dishwasher 10, the door 14 must be in the full door mode, which the user may select through the user interface 88. Once the door 14 is in the full door mode, the user may pivot the door 14 to its open position shown in FIG. 7 to access the dispenser 160. The user may extend the dispensing drawer 180 from the drawer 40 when the drawer 40 is extended, as shown in FIG. 7, or retracted by grasping the handle 202 and pulling the dispensing drawer 180 forward until the projections 200 abut the pins 188 (FIG. 6) that prevent further forward sliding movement of the dispensing drawer 180. With the dispensing drawer 180 extended, the user may insert the treating chemistry in its desired form (e.g., individual packages or cartridges, individual charges or bulk) into the compartments 162 of the dispensing drawer 180 and then push the dispensing drawer 180 to slide the dispensing drawer 180 for retraction into the space 182 formed by the bottom of the drawer 40. The user may then access the upper and lower treatment chambers 32, 34 as needed and may convert the door 14 between the door and drawer modes as desired for accessing the desired treatment chamber(s) 32, 34 until the user is ready to run a treating cycle in the dishwasher 10.

With the treating chemistry dispenser 160 supplied with the desired treating chemistry, the user may close the door 14 and select an operational treating cycle for the upper treating chamber 32, the lower treating chamber 34, or both the upper and lower treating chambers 32, 34. If treating cycles are selected for both of the upper and lower treating chambers 32, 34, the selected treating cycles for the upper and lower treating chambers 32, 34 may be the same treating cycle or differing treating cycles. The controller 210 executes the selected treating cycles according to preprogrammed instructions and information received from the various sensors 216, 218, 220.

At certain times during the execution of a treating cycle, a treating chemistry may be dispensed from the treating chemistry dispenser 160 into the upper treatment chamber 32 and/or the lower treatment chamber 34. The controller 210 instructs the treating chemistry dispenser 160 to dispense the appropriate treating chemistry by commanding the appropriate pump 164 to meter and dispense a suitable amount of the treating chemistry. The amount of the treating chemistry to be dispensed may depend on several factors, including, but not limited to, type of selected treating cycle, load size, load type, amount of soil on the utensils, etc., and these factors may be input by the user through the user interface 88 and/or may be sensed by one or more sensors in the dishwasher 10. As shown in FIG. 5, the dispensed treating chemistry flows through the compartment supply conduit 166, which feeds the dispensed treating chemistry to the dispensing diverter 168 that, in turn, supplies the dispensed treating chemistry to the dispensing conduit 170 for delivery to the upper return conduit 116. The dispensed treating chemistry may travel to the pump and filter unit 110 on its own, or the controller 210 may instruct the pump and filter unit 110 to send a supply of fluid received by the liquid supply system through the upper recirculation circuit to flush the upper return line 116 and deliver the dispensed treating chemistry to the pump and filter unit 110. The pump and filter unit then directs the dispensed treating chemistry and any fluid containing the dispensed treating chemistry to the upper treating chamber 32 through the upper supply conduit 112 or to the lower treating chamber 34 through the lower supply conduit 114. While supplying the dispensed treating chemistry to the desired treating chamber 32, 34, the pump and filter unit 110 may add fluid to the dispensed treating chemistry, if desired, from the liquid supply system.

Optionally, the pump and filter unit 110 may supply treating fluid containing dispensed treating chemistry previously used in one of the treating chambers 32, 34 to the other of the treating chamber 32, 34. In such a situation, the pump and filter unit 110 receives the used treating fluid from the appropriate upper and lower return conduit 116, 118 corresponding to the treating chamber 32, 34 that employed the treating fluid and directs the used treating fluid to the appropriate upper and lower supply conduit 112, 114 for use by the other treating chamber 32, 34. The controller 210 can optionally add additional treating chemistry and/or additional fluid to the used treating fluid prior to supplying the used treating fluid to the other treating chamber 32, 34.

When the dishwasher 10 no longer needs the used treating fluid containing the dispensed treating chemistry, the pump and filter unit 110 disposes the used treating fluid through the drain conduit 144.

It is within the scope of the invention for the treating chemistry dispensing system to be altered in the illustrated embodiment of the dishwasher 10 and to be adapted for use in other embodiments of the dishwasher 10. For example, one alternative embodiment may include a stationary partition or divider separating the upper and lower treating chambers 32, 34, and the treating chemistry dispenser 160 may be located adjacent the stationary partition, such as by being mounted to the stationary partition. As another option, the stationary partition need not be stationary but movable relative to the tub 16 and having a configuration different than a drawer. The treating chemistry dispenser 160 may be located elsewhere in the dishwasher 10, such as in other locations in the tub 16 or on the door 14. For example, the treating chemistry dispenser 160 may be mounted to an inside surface of the door 14 and may have a vertical orientation to fit between the door 14 and the utensil rack 56 when the door 14 is closed. The plumbing for such a dispenser may be fed through the lower end of the door 14 and below the tub 16 to the pump and filter unit 110.

In another embodiment, the treating chemistry dispenser 160 may be configured for access by a user without requiring concurrent access of one or more of the treating chambers 32, 34. For example, the treating chambers 32, 34 may both have the form of a drawer, and the treating chemistry dispenser 160 may be located between the drawers and accessible without having to open the drawers. Such a configuration would also be feasible with the treating chemistry dispense 160 being located above both of the treating chambers 32, 34 or below both of the treating chambers 32, 34.

In other alternative embodiments, the treating chemistry dispenser 160 may be in a form other than the dispensing drawer 180, i.e., a dispenser that does not slide for user access. The dispenser 160 may also be adapted to dispense and/or meter the treating chemistry in a manner other than through the conduits and pumps, such as by a flow or spray of liquid through the dispenser 160 or by other means. Further, the treating chemistry dispensing system may be configured to dispense the treating chemistry directly into the upper and lower treating chambers 32, 34 rather than into the liquid recirculation system. The plumbing of the treating chemistry dispensing system may also be modified so that the dispensing system has a dedicated conduit or line coupled directly to the pump and filter unit 10 rather than being coupled to one of the upper and lower return conduits 116, 118.

Further, while the illustrated embodiment shows a two compartment dishwasher with a single drawer and door, with the drawer being located in an upper position, any desired number of compartments may be used, and the arrangement of the compartments may vary. For example, if three compartments are desired, another drawer could be added. The second drawer could be located adjacent the first drawer to have two drawer compartments adjacent each other. The drawer compartments could be located at either the top or bottom of the door. Alternatively, the drawers could be spaced from each other, say one at the top and one at the bottom, with the door compartment lying between the drawer compartments. Alternatively, a single drawer could be placed in the middle of the door to form two door compartments, separated by a drawer compartment. In another embodiment, two vertically arranged drawers could be employed such that either drawer could be accessed independently with its respective door in a drawer mode, or both could be accessed simultaneously with the door in a full door mode. In this case, the door could be configured with separate openings in a frame through which the independent drawers may move when in drawer mode, or the door could be designed without a surrounding frame such that the drawers span the entire width of the dishwasher. Any conceivable combination and arrangements of drawer and door compartments could be used.

While the invention has been specifically described in connection with certain specific embodiments thereof, it is to be understood that this is by way of illustration and not of limitation, and the scope of the appended claims should be construed as broadly as the prior art will permit.

What is claimed is:

1. A dishwasher comprising:

a first tub at least partially defining a first treating chamber;

a second tub at least partially defining a second treating chamber and where the first and second treating chambers are fluidly isolatable from one another;

a recirculation system comprising a first recirculation circuit for recirculating liquid for the first tub, a second recirculation circuit for recirculating liquid for the second tub, and a single recirculation pump having an inlet fluidly coupled to the first and second recirculation circuits and an outlet selectively coupled to the first and second recirculation circuits; and a single bulk treating chemistry dispenser having multiple charges of treating chemistry, located between and fluidly isolated from the first and second treating chambers, and fluidly coupled to the first recirculation circuit via a dispensing conduit, wherein the treating chemistry is dispensed into the first recirculation circuit, and the recirculation system directs the dispensed chemistry to the second treating chamber by selectively coupling the outlet to the second recirculation circuit.

2. The dishwasher of claim 1 further comprising a divider separating the first and second treating chambers, and the bulk treating chemistry dispenser is located adjacent the divider.

3. The dishwasher of claim 2 wherein the divider comprises a wall separating the first and second treating chambers.

4. The dishwasher of claim 2 wherein the divider is one of the first and second tubs.

5. The dishwasher of claim 2 wherein the bulk treating chemistry dispenser is mounted to the divider.

6. The dishwasher of claim 5 wherein the bulk treating chemistry dispenser comprises a dispensing drawer slidably mounted to the divider.

7. The dishwasher of claim 6 further comprising a first drawer forming at least a portion of the first tub.

8. The dishwasher of claim 7 wherein the first and second tubs are in a stacked relationship and the divider comprises a portion of the first drawer, and the bulk treating chemistry dispenser is fluidly coupled to the first recirculation circuit of the first drawer.

9. The dishwasher of claim 8 further comprising a tub housing slidably receiving the first drawer, which fluidly separates the tub housing into two chambers to define the first and second tubs.

10. The dishwasher of claim 9 wherein the tub housing has an open face defining an open face for the second tub and through which the first drawer slides.

11. The dishwasher of claim 10 wherein a door overlies the entire open face and has an access opening through which the first drawer may slide when the door closes the open face.

12. The dishwasher of claim 1 wherein the recirculation system includes a return conduit and the bulk threating chemistry is dispensed from the bulk treating chemistry dispenser via the dispensing conduit into the return conduit.

13. The dishwasher of claim 1 wherein the recirculation system further includes a supply diverter to selectively couple the pump outlet to the first and second recirculation circuits.

14. A dishwasher comprising:

a first tub at least partially defining a first treating chamber;

a second tub at least partially defining a second treating chamber and where the first and second treating chamber are fluidly isolatable from one another;

a recirculation system comprising a first recirculation circuit for recirculating liquid for the first tub including an first return conduit, a second recirculation circuit for recirculating liquid for the second tub including a second return conduit fluidly uncoupled from the first return conduit, and a single recirculation pump having an inlet fluidly coupled to the first and second recirculation circuits and an outlet selectively coupled to the first and second recirculation circuits; and a single bulk treating chemistry dispenser having multiple charges of treating chemistry, located between and fluidly isolated from the first and second treating chambers, and fluidly coupled to the first recirculation circuit, wherein the treating chemistry is dispensed into the first recirculation circuit at the first return conduit, and the recirculation system directs the dispensed chemistry to the second treating chamber by selectively coupling the outlet to the second recirculation circuit.

* * * * *